United States Patent [19]

Tang

[11] 4,429,655

[45] Feb. 7, 1984

[54] SINGLE LEG TERMINAL

[75] Inventor: Phillip H. Tang, Rosemead, Calif.

[73] Assignee: Amtel, Inc., Providence, R.I.

[21] Appl. No.: 341,312

[22] Filed: Jan. 21, 1982

Related U.S. Application Data

[63] Continuation-in-part of Ser. No. 34,555, Apr. 30, 1979, Pat. No. 4,326,312.

[51] Int. Cl.[3] ..... B63B 21/52

[52] U.S. Cl. ..... 114/230; 285/158; 441/5

[58] Field of Search ..... 441/3-5, 441/1; 114/230, 264, 256, 257, 293; 405/195, 225, 202; 285/158

[56] References Cited

U.S. PATENT DOCUMENTS 3,430,597 3/1969 Zunderdorp ..... 114/230

3,455,270 7/1969 Mascenik et al. ..... 441/5 X 4,096,704 6/1978 Adamsom et al. ..... 114/230

*Primary Examiner*—Sherman D. Basinger

*Attorney, Agent, or Firm*—Freilich, Hornbaker, Wasserman, Rosen & Fernandez

[57] ABSTRACT

A single leg mooring terminal is described, of the type which includes a riser extending up from the sea floor to moor a vessel, and a separate fluid conduit extending up from the sea floor to carry oil to or from the vessel, and wherein the riser and hose structure must both rotate without limit about the same vertical axis to follow drifting of the vessel. A turntable near the sea floor, rotatably supports the riser about a vertical axis, and has a hole along its vertical axis through which a portion of the fluid conduit extends. A fluid swivel of the fluid conduit, lies under the turntable and is accessible through a hole in the turntable.

8 Claims, 6 Drawing Figures

FIG. 1
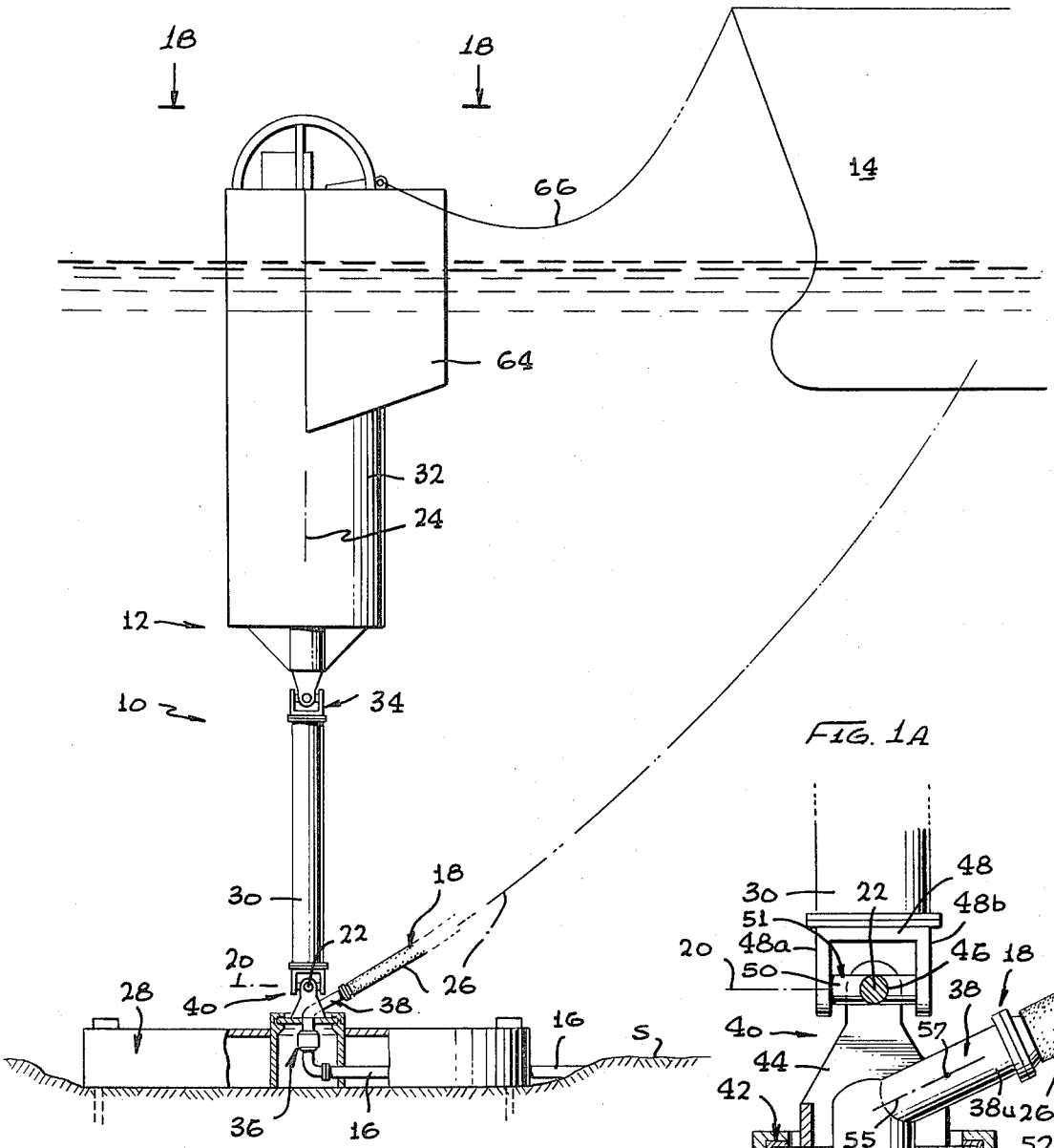
FIG. 1A
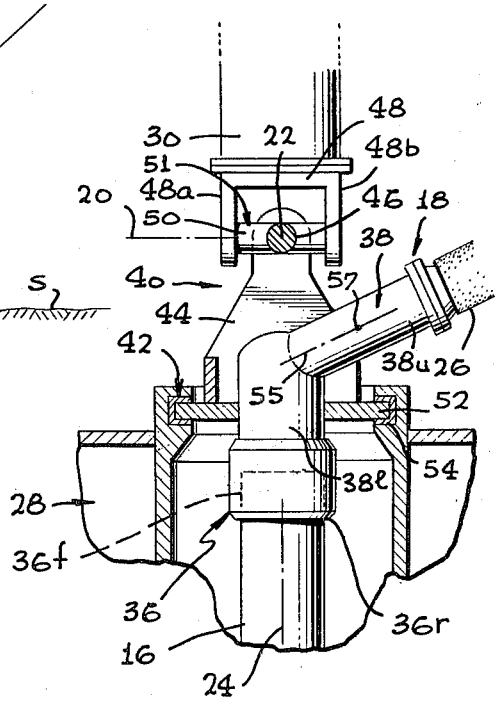
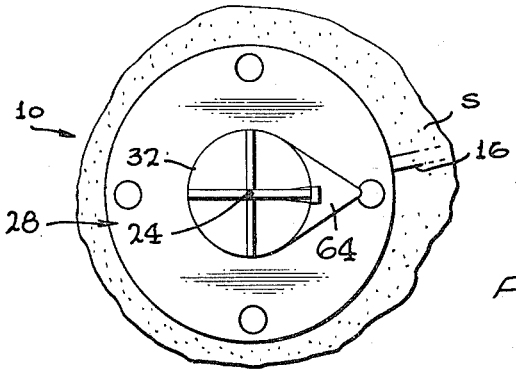
FIG. 1B

SINGLE LEG TERMINAL

CROSS-REFERENCE TO RELATED APPLICATIONS

This is a continuation-in-part of patent application Ser. No. 34,555 filed Apr. 30, 1979, now U.S. Pat. No. 4,326,312.

BACKGROUND OF THE INVENTION

One type of offshore installation utilized to moor a tanker and connect a hose to it, includes a column-like buoy assembly extending from the seabed to the sea surface and with its upper end tied by a hawser to the vessel, and a floating hose structure which extends at an upward incline from the seabed to the surface independently of the buoy assembly. The buoy assembly includes at least one tilt joint which allows it to tilt to follow limited movement of the vessel towards and away from the center of the installation. Both the buoy assembly and hose structure require joints that permit unlimited rotation about a substantially vertical axis, to follow drifting of the vessel about the center of the installation.

One common approach to permit rotation of the buoy assembly and hose structure about the same vertical axis, is to utilize an annular fluid swivel with a large hole in the center through which the buoy assembly extends. This permits the upward mooring load to be transmitted to the seabed without being transmitted directly through the fluid swivel. One disadvantage of this arrangement is that the annular fluid swivel cannot be removed without detaching the buoy assembly from the seabed. In addition, an annular fluid swivel is substantially more complex than a fluid swivel that does not require a hole along its axis of rotation.

One type of mooring installation that facilitates replacement of the fluid swivel while permitting a simple swivel to be utilized, positions the fluid swivel along the vertical axis of rotation, in a hollow portion of the buoy assembly. The buoy assembly has a side opening through which a pipe from the rotatable portion of the fluid swivel can pass sidewardly away from the buoy assembly. British Pat. No. 1,524,906 shows a few installations of this type, wherein the fluid swivel is located on the upper rotating part of the buoy installation where an opening can be provided for the sidewardly extending pipe. However, these designs involve the use of fluid-carrying tilt joints, such as flexible hoses, immediately below the fluid swivel, to carry fluid across a tilt joint of the buoy assembly. Such fluid tilt joints that are subjected to repeated tilting, are liable to breakdown and increase the maintenance requirements for the installation, as where a short section of a flexible hose is used which undergoes repeated considerable bending. A mooring installation of the type which has a hose structure extending to the vessel independently of much of the buoy assembly, which enabled a simple and easily accessed fluid swivel to be utilized without requiring the use of high maintenance underwater parts, would facilitate the construction and operation of mooring and cargo transfer installations.

SUMMARY OF THE INVENTION

In accordance with one embodiment of the present invention, a mooring installation is provided of the type that includes a tiltable and rotatable riser and buoy assembly for mooring a vessel and that also includes a separate fluid conduit that can rotate with the buoy assembly and vessel, which enables a simple, compact, and easily maintainable fluid swivel to be utilized while avoiding high maintenance parts. The vertical rotation joint which enables the upper portion of the buoy assembly to rotate about a vertical axis, is formed by a turntable located immediately below the tilt joint which permits the buoy assembly to tilt. The fluid conduit includes a fluid swivel that lies along the axis of the vertical rotation joint, under the turntable, to protect the fluid swivel from silt and to minimize the height of the apparatus in shallow water installations.

The novel features of the invention are set forth with particularity in the appended claims. The invention will be best understood from the following description when read in conjunction with the accompanying drawings.

BRIEF DESCRIPTION OF THE DRAWINGS

FIG. 1 is a side elevation view of a single leg mooring installation constructed in accordance with the present invention.

FIG. 1A is a side elevation view of a portion of the installation of FIG. 1.

FIG. 1B is a view taken on the line 1B—1B of FIG. 1.

FIG. 4 is a partial perspective view of the installation of FIG. 3.

DESCRIPTION OF THE PREFERRED EMBODIMENTS

Figure 2:
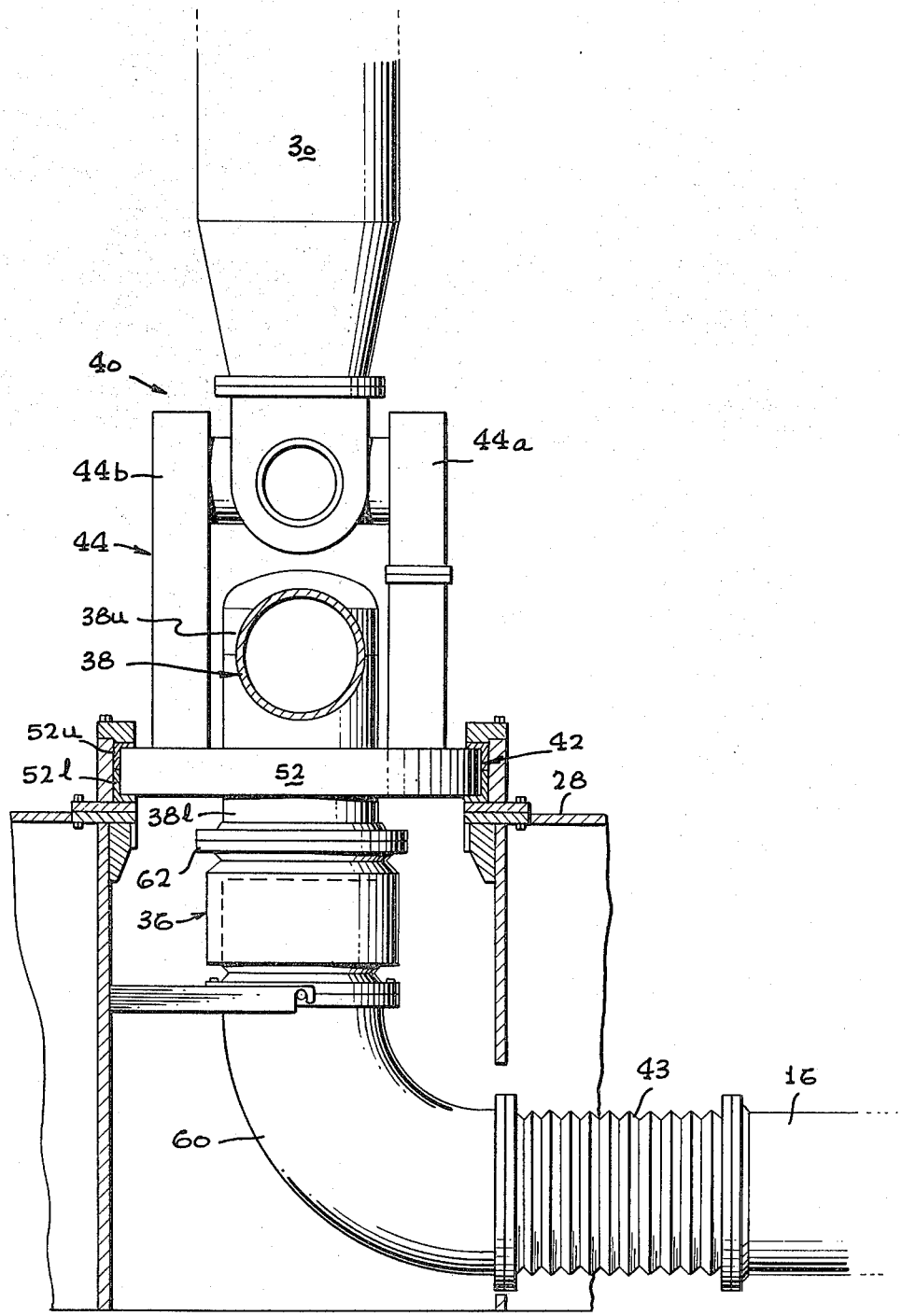
FIG. 2 is a partial sectional view of the installation of FIG. 1 but with the upper portion of the buoy assembly rotated 90° from the position shown in FIGS. 1 and 1A.

FIG. 1 illustrates a single leg mooring installation 10 which is installed on a seabed S, and which includes a riser and buoy assembly 12 that can moor a tanker vessel 14 while oil or gas is transferred from a seabed pipeline 16 through a fluid conduit 18 to the vessel. The buoy assembly 12 is designed so that it can tilt about horizontal axes such as 20 and 22 to resiliently anchor the vessel, and so that its upper portion can rotate without limit about a substantially vertical axis 24, to follow drifting of the vessel about the installation. The conduit 18 includes a hose structure 26 which is flexible along most of its length and that extends sidewardly from the buoy assembly 12, to extend independently of it up to the vessel. The hose structure 26 must also rotate without limit about the vertical axis 24 together with the buoy assembly to follow drifting of the vessel.

The riser and buoy assembly 12 includes a non-rotatable base 28 at the seabed, a riser 30 extending upwardly from the base, and a buoy 32 connected to the top of the riser by an upper tilt joint 34. As also shown in FIGS. 1A and 2, the conduit 18 includes a fluid swivel 36 lying on the vertical axis 24, and having a fixed portion **36*f* substantially fixed to the pipeline 16 and a rotatable portion 36*r*. The rotatable portion 36*r* of the fluid swivel connects to conduit portion formed by a pipe 38 that has a part angled to extend away from the axis 24 in a partially sideward direction and to connect to the hose structure 26**.

The bottom of the riser 30 is connected to the base 28 by a tilt joint 40 that permits tilting of the riser and buoy about the horizontal axes 20, 22 and also by a vertical rotation joint 42 that permits the riser and buoy to rotate about the vertical axis 24. It may be noted that a chain type riser can be used to hold the buoy. The tilt joint 40 includes a lower part in the form of a yoke 44 having a pair of upstanding arms 44*a*, 44*b*, and carrying a shaft 46. The tilt joint also includes an upper part in the form of a yoke 48 having a pair of arms 48*a*, 48*b* that carry another shaft 50. The two shafts 46, 50 are fixed together and form an intermediate part 51 pivotally jointed to the upper and lower parts of the tilt joint. The vertical rotation joint 42 includes a wide platform 52 which is rotatably mounted on bearings 54 about the vertical axis 24.

In accordance with the present invention, the vertical rotation joint 42 is located below the tilt joint 40, with the vertical rotation bearing 54 lying below the horizontal axes of pivoting at 20 and 22. In addition, the pipe 38 whose lower radially-inner end 38*l* extends vertically and whose upper radially-outer end 38*u* extends with a large horizontal directional component, is located so that its sidewardly-extending upper end portion 38*u* lies above the vertical rotation joint 42 but below the top of the tilt joint 40. It can be seen that the axis 55 of the upper pipe portion, crosses the adjacent radially outer portion of the lower yoke at 57, which is located above the vertical rotation bearing 54 but below the tilt axes 20 and 22. It may be noted that the tilt joint 40 should be located only a small distance above the vertical rotation joint, to minimize the tilting or overturning moment on the vertical rotation joint. As a result of the sidewardly-extending pipe portion 38*u* lying above the bottom of the vertical rotation joint but below the top of the tilt joint, only a simple fluid swivel 36 is required to accommodate the rotational movement of the upper pipe end 38*u* about the vertical axis. That is, the upper pipe end 38*u* does not have to undergo tilting movement to which the riser 30 is subjected. In addition, the upper end 38*u* of the pipe can rotate without limit about the vertical axis 24 together with rotation of the riser 30 and the buoy connected to it, to follow drifting of the ship. This is accomplished in a manner that permits relatively easy access to the fluid swivel 36, in that it can be removed without requiring the riser 30 to be detached from the base 28.

As shown in FIG. 2, which shows greater details of the installation, and which shows the pivot joint 40 after it has been rotated 90° from the orientation of FIG. 1A, removal of the fluid swivel 36 can be accomplished by a diver positioned under the vertical rotation joint 42. A large hole (not shown) is provided in the base 28 to permit such access. To remove the fluid swivel, the diver first detaches and lowers the ends of a pipe section 60 lying under the fluid swivel, from the fluid swivel 36. An expansion joint 43 facilitates such pipe section movement. The fluid swivel then can be detached from a flange 62 on the pipe 38. During such replacement of the fluid swivel, the buoy can continue to be connected through the pivot and vertical rotation joints to the base 28. The pipe 38 can be separately supported on the vertical rotation platform 52, and can include a domed lower portion 38*l* and a straight pipe upper portion 38*u* which intersects the top of the lower domed portion.

The mounting of the sidewardly-extending pipe 38*u* above the vertical rotation joint 42 but below the tilt joint 40, not only avoids the need for providing a fluid-carrying tilt joint along the pipe 38 to tilt with the buoy, but also can save space and more reliably rotate the rotatable portion of the fluid conduit 18. Saving of space and lightening of the installation is enhanced by the fact that there is already a space between the two legs of the lower yoke 44, and this space is utilized to pass the sidewardly-extending pipe 38*u*, which saves on material and space even though the yoke 44 is somewhat taller than otherwise. It may be noted that the upper portions of the arms 44*a*, 44*b* can be connected together above the pipe 38. The yoke 44 or a bracket extending from the rotatable platform 52 can serve to apply the necessary torque to the pipe 38 to assure that it rotates with the buoy, with minimal strain applied to the pipe 38. It should be noted that the sidewardly-extending pipe 38*u* can be a flexible hose, although a relatively rigid pipe is preferred because of increased reliability.

The large diameter rotating platform 52, which has a diameter much greater than the vertical distance between its upper and lower bearings at 54*u*, 54*l*, provides a wide base to support the rotating pipe 38 and apply torque to it to rotate it with the buoy. It is possible to use a small diameter vertical rotation joint, with the upper and lower bearings spaced at greatly different levels to withstand moderate tilting force. However, such a small diameter rotating platform cannot easily apply torque to the sidewardly-extending pipe to rotate it, without the addition of a separate cantilevered beam extending from the small platform. In one system designed as shown in FIG. 2, the rotating platform 52 had a diameter of about two meters, and the other parts were proportioned as illustrated.

Figure 3:
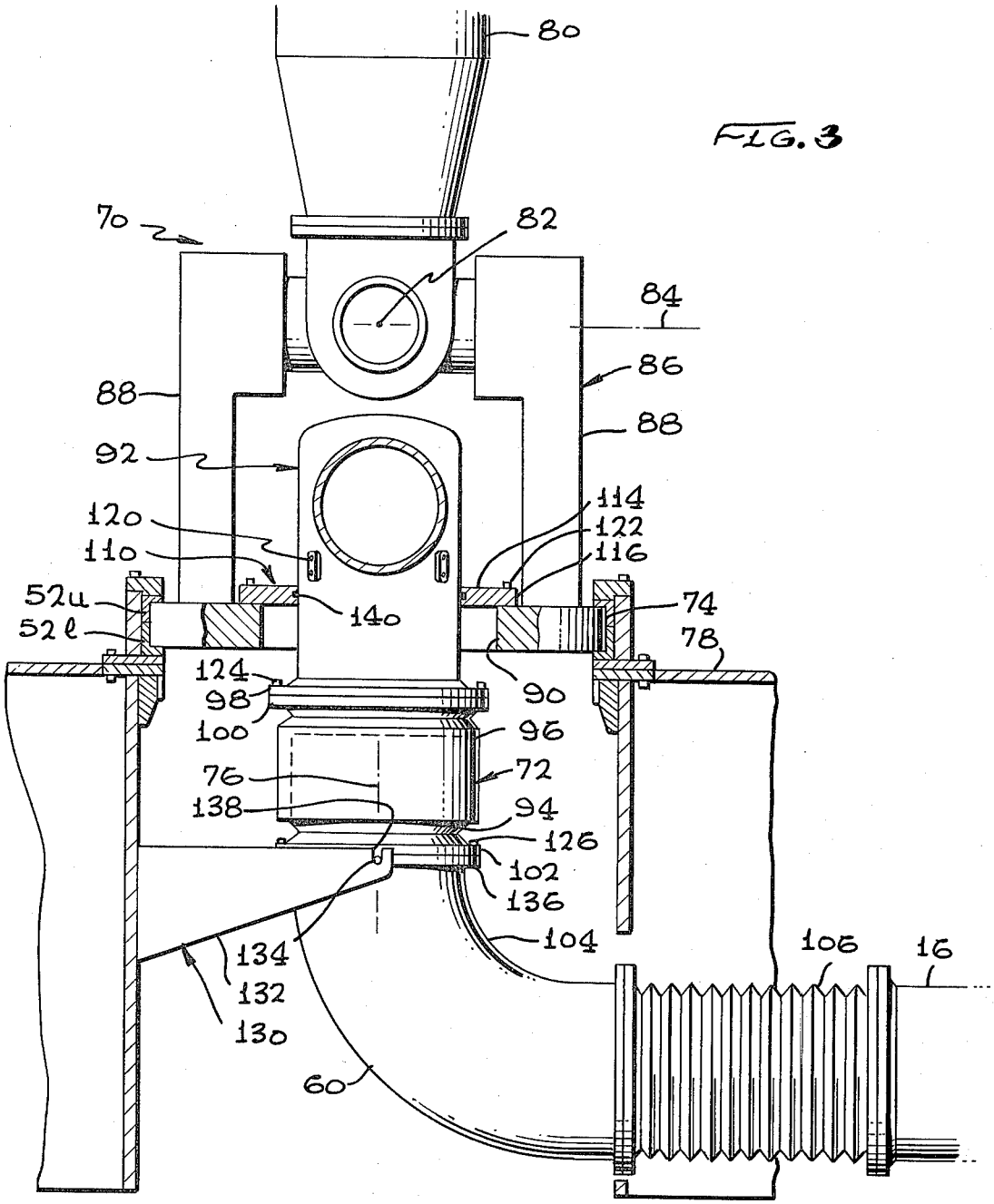
FIG. 3 is a partial sectional view of a mooring installation constructed in accordance with another embodiment of the invention.
Figure 9:
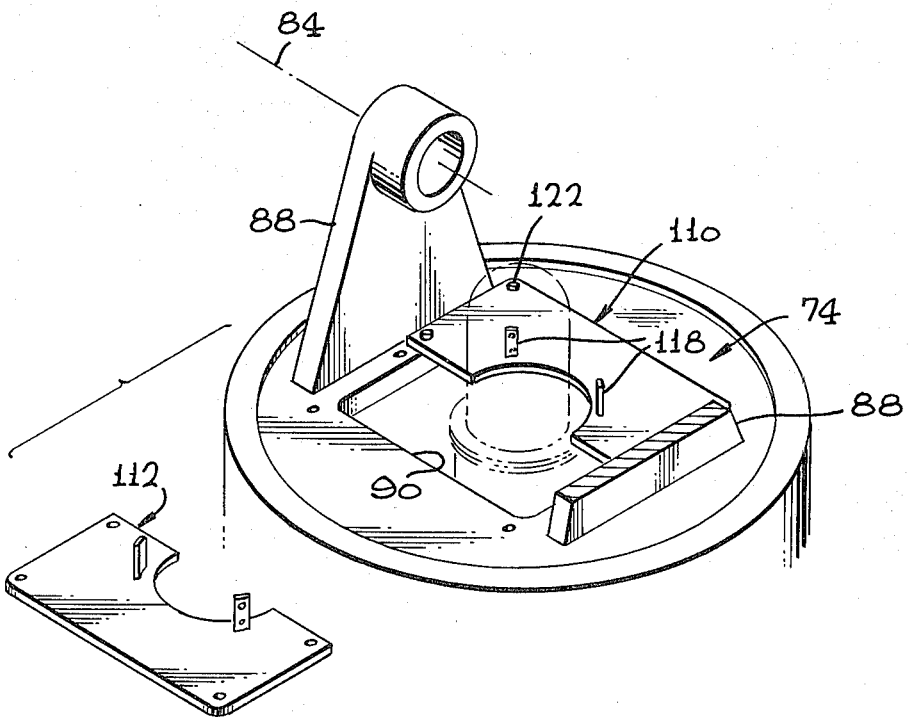

FIGS. 3 and 4 illustrate another mooring installation 70, which is designed to protect the fluid swivel 72 while facilitating its removal for repair. The installation is largely similar to that of FIG. 2, with a turntable 74 rotatably mounted about a vertical axis 76 on a sea base 78. A riser 80 is pivotally mounted about two horizontal axes 82, 84 on a yoke-like member 86, and the yoke member has legs 88 fixed to the turntable 74 near the radially outer portion thereof. This leaves the middle of the turntable, through which the axis 76 extends free of obstruction from the yoke, and the turntable has a hole 90 at its middle portion.

The fluid conduit includes a pipe transition element 92 similar to that of FIG. 2, which extends through the hole 90 in the turntable. The lower end of the pipe element is connected to the fluid swivel 72. The fluid swivel has a stationary portion 94 emerging at its lower end, and a rotatable portion 96 at its upper end. The pipe element 92 has a flange 98 at its lower end which connects to a flange 100 on the rotatable part of the fluid swivel. The nonrotatable part 94 of the fluid swivel includes a flange 102 connected to an elbow pipe 104, that is connected through a flexible or expansion joint 106 to the undersea pipeline 16.

The pipe transition element 92 can be securely mounted on the turntable 9 by a pair of cover plate elements 110, 112 (FIG. 4). Each of the cover elements has an inner portion 114 (FIG. 3) that closely surrounds the pipe element 92 to seal to it, and has an outer portion 116 that lies on the turntable and can be fastened thereto. Each cover element can be provided with a pair of upstanding posts 118 that can be fastened to corresponding bosses 120 formed on the pipe element.

If the fluid swivel must be removed, this can be accomplished without removing the riser 80, by first removing the cover elements 110, 112. This is accomplished by removing the fasteners 122 that hold each cover element to the turntable, and by removing the fasteners that hold each cover element to the pipe element 92. Fasteners 124 that hold the pipe element 92 to the top of the fluid swivel can be removed, and additional fasteners 126 that hold the bottom of the fluid swivel to the pipe 104 can be removed. Both the pipe element 92 and the fluid swivel 72 can be withdrawn through the hole 90 in the turntable. The hole 90 has a width, in a direction parallel to the axis 84 that connects the two legs 88 of the yoke, which is only slightly wider than the fluid swivel 72. However, the hole 90 has a length perpendicular thereto, which is much greater than the width of the hole, to facilitate removal of the pipe element 92 by tilting it, and to also facilitate removal of the fluid swivel 72, as by providing room for a diver to reach the bottom of the fluid swivel.

During normal use of the terminal, the turntable 74 may be subjected to heavy loads that cause it and the fluid conduit portions attached thereto such as the fluid swivel 72, to undergo slight movement. The expansion joint 106 accommodates such movement. During rotation of the turntable and the rotatable part 96 of the fluid swivel, some torque is applied to the nonrotatable part 94 of the swivel. Such torque is resisted by an arm 130 which has one end fixed to the sea base 78 and another portion 132 coupled to a non-rotatable portion of the fluid swivel. Both the nonrotatable fluid swivel part 94 and the flange 102 and pipe 104 extending to the expansion joint 106 is normally rigidly fixed together, and can all be considered as part of a non-rotatable fluid swivel portion. In particular, a shaft 134 is fastened to a flange 136 on the elbow pipe 104, and is received in a vertical slot 138 of the arm 130. The arm 130 permits small up and down movements of the non-rotatable fluid swivel portion, while preventing more than a small degree of rotation about the vertical axis 76. Two of such arms 130 and corresponding shafts 134 can be provided, one on each side of the fluid conduit. When the fluid swivel 72 is to be removed, the arms 130 can temporarily support the weight of the fluid swivel, and after its removal can support the weights of the elbow pipe 104. It is also possible to construct the installation so that during normal usage the pipe element 92 can slide vertically relative to the turntable, and to use the arms 130 to support the weight.

The terminal construction of FIGS. 3 and 4, by locating the fluid swivel 72 below the turntable 74, has the advantage of protecting the fluid swivel against silt. The cover elements 110, 112 can be sealed by an O-ring 140 to the pipe element 92, and are sealed to the turntable, to keep out such silt. The positioning of the fluid swivel under the turntable also helps to minimize the height of the installation, to facilitate its use in shallow water. The provision of a hole 90 in the turntable, facilitates maintenance of the insallation, by enabling the fluid swivel to be removed through that hole, all without requiring removal of the riser 80.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. In a single leg mooring installation which includes a riser assembly extending up from the sea floor to near the sea surface to moor to a vessel, and a fluid conduit which can extend upwardly from the sea floor and sidewardly from an underwater location to the vessel to transfer a fluid cargo between a pipe near the sea floor and the vessel, and wherein the upper portion of the riser assembly must be tiltable and the upper portions of both the riser assembly and fluid conduit must be capable of rotating without limit about a substantially vertical axis to follow a drifting vessel, the improvement wherein:

said riser assembly includes a nonrotatable base lying at the sea floor, a turntable rotatably mounted on the base to rotate about a vertical axis thereon and having a hole at said axis, and a yoke-like member having a pair of upstanding leg portions with lower ends mounted on radially outer portions of said turntable to leave the middle of the turntable free of obstruction, said yoke-like member having an upper portion pivotably connected to the lower portion of said riser assembly;

said fluid conduit includes a fluid swivel lying under said turntable and having a rotatable portion rotatable about said vertical axis, and also includes a pipe transition element extending through said hole in said turntable and having a lower end coupled to said rotatable portion of said fluid swivel and an upper end lying above said turntable and extending at an angle to said vertical axis; and means for sealing said pipe element to said turntable to resist the entry of silt into the area under said turntable occupied by said fluid swivel, said means including at least one member having a radially outer portion directly mounted on an area of said turntable that surrounds said hole and an inner portion sealed to said pipe.

2. The improvement described in claim 1 wherein:

said means for sealing includes means for fastening said pipe element to said turntable, and including means for fastening said fluid swivel to a lower end of said pipe element, so the pipe element and fluid swivel are supported on said turntable;

a flexible pipe joint, said fluid swivel having a stationary portion, and said flexible joint connecting said pipe near the sea floor to said stationary fluid swivel portion to permit them to move slightly relative to each other while passing fluid between them; and a rotation limiter extending from said sea base and coupled to the nonrotatable portion of said fluid swivel to prevent it from unlimited rotation.

3. Apparatus for supporting a riser above the sea floor for rotation about a vertical axis, and for supporting a fluid conduit in rotation about the same axis while it is connected to a pipeline at the sea floor, comprising:

a base part mounted on the sea floor;

a turntable mounted on the base to rotate about a vertical axis thereon, said turntable having a hole at said axis;

means for mounting said riser on said turntable, including a yoke-like device having legs fixed to said turntable on largely opposite sides of said hole therein;

said fluid conduit including a pipe element extending through said hole in said turntable between the legs of said yoke-like device, and a fluid swivel having a rotatable part connected to and substantially fixed to said pipe element and a nonrotatable part;

means for attaching said pipe element to said turntable; and an arm having opposite ends fastened to said sea base and to substantially said nonrotatable part of said fluid swivel to prevent rotation of said nonrotatable swivel part about a vertical axis, at least one end of said arm being detachable from the part to which it is fastened.

4. Apparatus for supporting a riser above the sea floor for rotation about a vertical axis, and for supporting a fluid conduit in rotation about the same axis while it is connected to a pipeline at the sea floor, comprising:

a base mounted on the sea floor;

a turntable mounted on the base to rotate about a vertical axis thereon, said turntable having a hole at said axis;

means for mounting said riser on said turntable, including a yoke-like device having legs fixed to said turntable on largely opposite sides of said hole therein;

said fluid conduit including a pipe element extending vertically through said hole in said turntable between the legs of said yoke-like device, a fluid swivel having a rotatable part connected to and substantially fixed to said pipe element and a nonrotatable part, and a pipe joint coupling said nonrotatable part of said fluid swivel to said pipeline at the sea floor; and means for coupling said pipe element to said turntable;

said hole in said turntable being larger than the portion of the pipe element extending therethrough so as to form a gap between said pipe element and said turntable and larger than said swivel unit to permit its passage therethrough, said fluid swivel lying under said turntable, and including attaching means of smaller diameter than said turntable and bridging said gap between said turntable and said vertically-extending pipe element to seal the space between them.

5. The apparatus described in claim 4 wherein:

said hole in said turntable is elongated, with a width parallel to an imaginary line that joins said legs, that is slightly wider than said fluid swivel, and a length greater than said width, whereby to facilitate fluid swivel removal while minimizing turntable diameter.

6. Apparatus for supporting a riser above the sea floor for rotation about a vertical axis, and for supporting a fluid conduit in rotation about the same axis while it is connected to a pipeline at the sea floor, comprising:

a base mounted on the sea floor;

a turntable mounted on the base to rotate about a vertical axis thereon, said turntable having a hole at said axis;

means for mounting said riser on said turntable, including a yoke-like device having legs fixed to said turntable on opposite sides of said hole therein;

said fluid conduit including a pipe element extending through said hole in said turntable between the legs of said yoke-like device, a fluid swivel having a rotatable part connected to and substantially fixed to said pipe element and a nonrotatable part, and an expansion pipe joint connecting said nonrotatable portion of said fluid swivel to said pipeline at the sea floor;

means for attaching said pipe element to said turntable; and means coupled to said sea base for limiting rotation of said nonrotatable portion of said fluid swivel about a vertical axis, to avoid torque on said expansion joint, including an arm mounted to said sea base and having a vertically extending slot adjacent to said nonrotatable portion of said fluid swivel, said nonrotatable portion of said fluid swivel having a projection received in said slot to prevent more than slight rotation of said nonrotatable swivel portion.

7. Apparatus for supporting a riser above the sea floor for rotation about a vertical axis, and for supporting a fluid conduit in rotation about the same axis while it is connected to a pipeline at the sea floor, comprising:

a base mounted on the sea floor;

a turntable mounted on the base to rotate about a vertical axis thereon, said turntable having a hole at said axis;

means for mounting said riser on said turntable, including a yoke-like device having legs fixed to said turntable on opposite sides of said hole therein;

said fluid conduit including a pipe element extending through said hole in said turntable between the legs of said yoke-like device, a fluid swivel having a rotatable part connected to and substantially fixed to said pipe element and a nonrotatable part, and a pipe joint coupling said nonrotatable part of said fluid swivel to said pipeline at the sea floor;

means for coupling said pipe element to said turntable;

said hole in said turntable being larger than the portion of the pipe element extending therethrough and larger than said swivel unit to permit its passage therethrough; and a plurality of cover plate elements that have outer portions lying on areas of said turntable that surround said hole, said cover plate elements having inner portions that closely surround said pipe element to seal to it, and a plurality of fasteners that detachably fasten said cover plate elements to said turntable.

8. Apparatus for supporting a riser above the sea floor for rotation about a vertical axis, and for supporting a fluid conduit in rotation about the same axis while it is connected to a pipeline at the sea floor, comprising:

a base mounted on the sea floor;

a turntable mounted on the base to rotate about a vertical axis thereon, said turntable having a hole at said axis;

means for mounting said riser on said turntable, including a yoke-like device having legs fixed to said turntable on largely opposite sides of said hole therein;

said fluid conduit including a pipe element extending through said hole in said turntable between the legs of said yoke-like device, a fluid swivel having a rotatable part connected to and substantially fixed to said pipe element and a nonrotatable part, and a pipe joint coupling said nonrotatable part of said fluid swivel to said pipeline at the sea floor;

means for coupling said pipe element to said turntable;

said hole in said turntable being larger than the portion of the pipe element extending therethrough so as to form a gap between said pipe element and said turntable and larger than said swivel unit to permit its passage therethrough, and including attaching means bridging said gap between said turntable and said pipe element to seal the space between them; and an arm fixed to said sea base and means for coupling said arm to the nonrotatable part of said fluid swivel so that said arm can support at least some of the weight of said swivel and prevent rotation thereof.

* * * * *